US011950664B2

(12) United States Patent
Götze et al.

(10) Patent No.: US 11,950,664 B2
(45) Date of Patent: Apr. 9, 2024

(54) SPRING RING CLASP AND METHOD OF PRODUCING A SPRING RING CLASP

(71) Applicant: GÖTZE & GÖTZE Ltd., St. Francois (MU)

(72) Inventors: Rainer Götze, St. Francois (MU); Philip Götze, St. Francois (MU)

(73) Assignee: Götze & Götze Ltd., St. Francois (MU)

( * ) Notice: Subject to any disclaimer, the term of this patent is extended or adjusted under 35 U.S.C. 154(b) by 0 days.

(21) Appl. No.: 17/884,647

(22) Filed: Aug. 10, 2022

(65) Prior Publication Data

US 2023/0046667 A1 Feb. 16, 2023

(30) Foreign Application Priority Data

Aug. 13, 2021 (EP) ..... 21191339

(51) Int. Cl.
*A44B 15/00* (2006.01)

(52) U.S. Cl.
CPC ..... *A44B 15/007* (2013.01)

(58) Field of Classification Search
CPC ... A44C 5/2038; A44C 5/2014; A44B 15/007; Y10T 24/45283; F16B 45/057
See application file for complete search history.

(56) References Cited

U.S. PATENT DOCUMENTS 917,038 A * 4/1909 Forsell ..... A44C 5/2014 70/459
1,017,458 A * 2/1912 Piper ..... A44C 5/2014 24/598.3
1,209,615 A * 12/1916 Obsboum ..... F16B 45/057 24/598.2
1,244,599 A * 10/1917 Goozey ..... A44C 5/2014 70/459
1,340,206 A * 5/1920 Ballou, Jr. ..... A44C 5/2014 24/598.3
1,386,746 A * 8/1921 Wachenheimer .... A44C 5/2014 70/459
1,442,096 A * 1/1923 Robinson ..... A44C 5/2014 24/598.3
1,449,175 A * 3/1923 Grunebaum ..... A44C 5/2014 63/3.1

(Continued)

FOREIGN PATENT DOCUMENTS

FR 2305950 10/1976

*Primary Examiner* — Robert Sandy
*Assistant Examiner* — Louis A Mercado
(74) *Attorney, Agent, or Firm* — Volpe Koenig

(57) ABSTRACT

A spring ring clasp, with a closed state in which the spring ring clasp (1) forms a closed ring (2), and with an opened state in which the ring (2) is opened, having an external tube (3), an internal tube (4) which in an overlap region (5) protrudes into the external tube (3), and a spring (6) which is disposed in a cavity (7) configured by the external tube (3) and the internal tube (4). For opening the spring ring clasp (1), the external tube being displaceable relative to the internal tube (4) counter to a spring force caused by the spring (6), and the spring (6) at least in the closed state protruding from the internal tube (4) and protruding into the external tube (3). The use of such a spring ring clasp (1) is in the jewelry industry but is not limited to this sector.

18 Claims, 2 Drawing Sheets

(56) References Cited

U.S. PATENT DOCUMENTS

| | | | | | |
|---|---|---|---|---|---|
| 2,222,053 | A * | 11/1940 | Anthony | F16B 45/04 | 70/459 |
| 4,329,765 | A * | 5/1982 | Nakagawa | C25D 7/04 | 29/458 |
| 4,483,050 | A * | 11/1984 | Nanni | A44C 5/2014 | 24/598.3 |
| 7,726,152 | B2 * | 6/2010 | Beard | A44C 5/2076 | 63/3.1 |
| 2009/0013721 | A1 | 1/2009 | Murao | | |
| 2015/0040358 | A1 * | 2/2015 | Burns | A44C 5/2014 | 24/600.5 |

* cited by examiner

SPRING RING CLASP AND METHOD OF PRODUCING A SPRING RING CLASP

TECHNICAL FIELD

The invention relates to a spring ring clasp with a closed state in which the spring ring clasp forms a closed ring, and with an opened state in which the ring is opened, having an external tube and a spring. The invention furthermore relates to the production of a spring ring clasp.

BACKGROUND

Spring ring clasps of this type are known in practice and are used for closing key rings or items of jewelry such as, for example, chains or the like. Spring ring clasps in which the spring is disposed in a cavity formed by the external tube are known from the prior art. Spring ring clasps known from the prior art in most instances have a pin for guiding the spring. This pin protrudes beyond an opening of the external tube and into the cavity of the spring ring clasp, as a result of which dirt particles can invade the cavity. Moreover, the production of a spring ring clasp of this type requires a multiplicity of steps, tools and dexterity and is therefore complex. Moreover, the externally visible part of the pin compromises the esthetic appeal of a spring ring clasp, in particular in the case of an item of jewelry.

SUMMARY

It is thus the object of the invention to improve spring ring clasps.

In order for the object mentioned to be achieved, one or more of the features disclosed herein are provided according to the invention. In order to achieve the object mentioned in a spring ring clasp of the type described at the outset it is thus in particular proposed according to the invention that the spring ring clasp has an internal tube which in an overlap region protrudes into the external tube, and that the spring is disposed in a cavity configured by the external tube and the internal tube, the external tube for opening the spring ring clasp being displaceable relative to the internal tube counter to a spring force caused by the spring, and the spring at least in the closed state protruding from the internal tube and protruding into the external tube.

The overlap region in the opened state is larger than in the closed state. Therefore, the overlap region is enlarged when the spring ring clasp is opened.

In this way, the external tube can be used in an optimal manner for opening the spring ring clasp.

A spring ring clasp configured according to the invention furthermore has the advantage that the entire clasp mechanism can be invisible, this offering more freedom for the esthetic design of the spring ring clasp. It suffices to displace the external tube in relation to the internal tube in order for the spring ring clasp to be opened and closed. Since the spring is disposed in a cavity formed by the internal tube and the external tube, said spring, as a function of the specific design of the internal tube and of the external tube, can be rendered invisible to the user in a simple manner.

The spring, which protrudes from the internal tube at least in the closed state, improves the spring ring clasp, for example because the spring can be placed in the internal tube in a simple manner during assembly and/or during repair work. It is specifically the case that the relaxed spring usually does not protrude from the internal tube during assembling of the ring, because the spring for reasons of assembly is configured to be short. In contrast, in clasps known from the prior art the spring is introduced into the ring during assembling and in the process reaches up to a slot situated in the ring. The pin, under the effect of force, is now guided into the slot and toward the spring end that is situated on the slot, this requiring a high level of dexterity. The assembly of a spring ring clasp configured according to the invention is significantly simpler because the external tube can be pushed over the internal tube, the spring thus being automatically tensioned. The assembly and repair jobs are simplified in this way.

The spring protruding from the internal tube at least in the closed state furthermore leads to the spring being configured so as to be longer than a spring that does not protrude from the internal tube. The extended spring travel caused as a result has the effect of a less harsh clasp mechanism and in this way improves the closing mechanism.

The longer spring travel furthermore has the advantage that a greater degree of freedom for the design of the shape of the ring is created, because the spring can flexibly adapt to the shape. In this way, a long spring can be used in oval spring ring clasps, for example.

Furthermore, the guidance of the spring ring clasp by the overlap region can be configured in the very robust and advantageous manner.

The spring is preferably configured as a coil spring.

The internal diameter of the external tube in the overlap region is preferably adapted to the external diameter of the internal tube such that there is only minimal play between the external tube and the internal tube. In this way, the spring ring clasp can be designed so as to be able to be readily closed and opened while at the same time saving material. For example, the external tube and the internal tube are preferably configured in the shape of circular segments, wherein the external tube can be configured so as to be shorter than the internal tube. In this way, material can be advantageously saved as a result of a short external tube. This reduction in terms of material can also facilitate the esthetic appeal because the spring ring clasp has a uniform external appearance.

According to the invention, the spring ring clasp has a closed state in which the spring ring clasp forms a closed ring. The ring may be circular, oval or generally round, round in this context meaning that the ring does not have any edges. However, the ring may also have edges and for example may have a polygonal line with and without radiused portions.

The spring between the opened, preferably completely opened, state and the closed state preferably protrudes from the internal tube and into the external tube. Particularly preferably, the spring does not protrude from the internal tube only in the completely opened state. The spring here can terminate so as to be flush with an outer end of the internal tube.

In one advantageous design embodiment it can be provided that the internal tube and the external tube in the opened state each configure free ends which contact each other in the closed state. Free ends can be the end portions of the internal tube and external tube, which in the opened state are designed so as to self-supporting in space and are preferably open. In this way, the spring ring clasp in the closed state thereof can be stabilized. Furthermore, the free ends can be mutually adapted so that the adjustment of the internal tube in relation to the external tube can be more precise.

The free end of the internal tube in the closed state preferably engages in the free end of the external tube. As a result, a second overlap region which significantly improves the stability and the security of the spring ring clasp in the closed state is formed. An engagement can be achieved, for example, in that in the external tube a detent on the end thereof is configured so as to be offset to the rear and thus does not reach up to an outer end of the external tube.

In one advantageous design embodiment it can be provided that a detent is configured on or in the external tube and/or in the internal tube. The detent can in particular serve as a stop and prevent that the spring ring clasp in the case of a pretensioned spring is moved beyond a certain degree during closing. Furthermore, an introduction of dirt particles into the cavity can be minimized by means of the detent.

A detent can be configured as, for example, a plate, an eyelet or preferably as a ring. The detent can in particular be soldered to or in the internal tube or the external tube, or be configured as a molding of one of the previously mentioned tubes. In this way, the detent can be fastened in a stable manner to or in the internal tube or external tube.

The external tube and the internal tube can be made from a metal such as in particular from a precious metal. The material should have a high level of stiffness and dimensional stability but should also be pliable because the manufacturing of the spring ring clasp can be simplified as a result of pliability. For special orders, the external tube and/or the internal tube can also be flexural and/or have little dimensional stability.

The detents can contact each another in particular in the closed state. In this way, the detents can be mutually aligned to an exact fit, as a result of which the spring ring clasp can be closed in a stable manner and the closed state can be maintained, in particular in the case of a second overlap region being configured.

In one advantageous design embodiment it can be provided that a spring detent, which in the opened state and in the closed state is contacted by the spring, is configured in the external tube. Alternatively or additionally, it can be provided that a spring detent which in the opened state and in the closed state is contacted by the spring is configured in the internal tube. The spring for pretensioning can thus advantageously be pushed onto the spring detents. It is furthermore advantageous, in particular when the internal tube and the external tube have a spring detent, that the spring can be guided within the internal tube by the spring detents without the spring jumping out at the free end of the internal tube.

Like the detents, the spring detents can also be soldered to or in the internal tube or the external tube, or be configured as a molding of one of the two tubes. The production of the internal tube or the external tube, and thus the production of the spring ring clasp, can thus be optimized, for example because the attachment of spring detents may be able to be carried out almost contemporaneously with the attachment of the detents.

The spring detent and the detent are particularly preferably identical, this saving even more in terms of costs, time and weight, and thus potentially improving the production of the spring ring clasp and the properties of the latter. It can moreover be achieved as a result that the available spring travel is enlarged.

In one advantageous design embodiment it can be provided that the external tube on the free end thereof is opened. Alternatively or additionally, it can be provided that the internal tube on the free end thereof is opened. The openings permit any exchange of liquid so that no liquid that would be aggressive to the material of the spring ring clasp can accumulate in the cavity. Therefore, the openings can improve the durability of the spring ring clasp. The openings also permit interesting design variants such as the creation of hoop earrings.

It can in particular be provided here that a or the detent configured in the external tube has an opening such that said detent does not completely close the external tube, and/or wherein a or the detent configured in the internal tube has an opening such that said detent does not completely close the internal tube.

In one advantageous design embodiment it can be provided that exclusively the spring is disposed in the cavity. This reduces the number of components and increases the available spring travel. Moreover, the spring in this way may thus have little or no possibility of moving within the cavity, as a result of which any abrasion of the spring on an inside of the internal tube or external tube can be minimized, as a result of which the spring ring clasp can be designed with a longer service life.

It can in particular be provided here that the spring ring clasp is composed of the external tube, the internal tube and the spring. In this way, a spring ring clasp can be made from only three component parts, wherein the internal tube or the external tube can have detents and/or spring detents as described above. The external tube and/or the internal tube here can also have fastening elements or closure aids, for example. Therefore, the spring ring clasp can be produced in an extremely simple manner, for example because a die or the like is dispensed with. When completely assembled, the spring ring clasp can already configure an esthetic ring, preferably without any further, external clasp components. A spring ring clasp of this type can be made in a cost-effective manner with minimal complexity, which is advantageous.

In one advantageous design embodiment it can be provided that the spring in the opened and in the closed state is completely covered by the tubular assembly formed by the internal tube and the external tube. The clasp mechanism can thus be completely invisible, this permitting esthetically appealing designs. It can furthermore be prevented as a result that dirt particles or moisture compromise or influence the function of the spring. Since the spring in the opened state as well as in the closed state is completely covered by the tubular assembly formed by the internal tube and the external tube, the spring during pretensioning cannot catch on any potential openings, which is advantageous.

It can be provided that at least one gripping element is attached to an outside of the external tube and/or of an outside of the internal tube. A gripping element can simplify the opening and closing of the spring ring clasp, in particular in the case of spring ring clasps with a small diameter. In terms of the esthetic appeal and/or the production it may be advantageous that the at least one gripping element can be attached to an outside of the external tube and/or the internal tube.

Alternatively however, the invention also permits design embodiments in which the external tube and the internal tube, in particular the entire spring ring clasp, are/is free from gripping elements, in particular free from attached gripping elements and free from notches, as well as free from other elements. Design embodiments of this type enable particularly esthetic designs, and are free from parts on which injury may occur or which could be particularly stressed in mechanical terms.

In order for the stiffness to be increased and the guiding of the internal tube in the external tube to be improved, it can be provided in a further advantageous design embodiment that the external tube and/or the internal tube on the shell face thereof are/is completely closed. As a completely closed shell face, the latter can be made without joints or slots, as a result of which the stiffness of the external tube and/or of the internal tube can be increased. Twisting, and unintentional opening of the spring ring clasp as a result, can be prevented by an increased stiffness.

In one further advantageous design embodiment it can be provided that a portion of the spring that in the closed state protrudes from the internal tube is more densely wound than a portion of the spring that in the closed state is situated in the internal tube. It is advantageous here that, when opening the spring ring clasp, thus when retracting the external tube, in which process the spring is compressed in the direction of the free end of the internal tube, it can be prevented as a result of the dense winding of the spring that the spring catches on the internal tube.

In one further advantageous design embodiment it can be provided that at least one fastening element for fastening the spring ring clasp to an item of jewelry is configured on the internal tube and/or the external tube. The fastening element here can be configured as an eyelet, for example. An item of jewelry can be, for example, a chain, a pendant or a clip. The spring ring clasp can be used in a variety of ways in that the spring ring clasp by way of the fastening element can be connected to an item of jewelry or to a ring holder which is not configured as an item of jewelry.

In one further advantageous design embodiment it can be provided that the spring ring clasp is configured for hooking in an item of jewelry.

It can be provided that the spring ring clasp has a diameter of less than 10 mm, preferably of less than 6 mm. A spring ring clasp with a diameter of less than 10 mm, preferably less than 6 mm, is advantageous in particular in the jewelry industry since the esthetic appeal of an item of jewelry can be improved in this way because the spring ring clasp can be kept small. The advantages of the proposed solution according to the invention are particularly relevant specifically in small spring ring clasps of this type, because the spring and the internal tube can determine the guidance of the clasp mechanism and no further, interfering components are required for this purpose.

Alternatively, a spring ring clasp can also have a diameter of more than 10 mm.

In one further advantageous design embodiment it can be provided that configured on the free end of the external tube is a pin which in the closed state protrudes into the internal tube. The pin here preferably protrudes through an opening of a detent and/or spring detent configured on or in the internal tube and/or through a portion of the spring. Alternatively or additionally, it can be provided that configured on the free end of the internal tube is a pin which in the closed state protrudes into the external tube, in particular through an opening of a detent and/or spring detent configured on or in the external tube and/or through a portion of the spring. The detents, spring detents and the openings thereof are preferably those already mentioned above. As a result of design embodiments of this type, the spring ring clasp can be closed in an even more stable manner, because the pin protrudes into the internal tube and further minimizes inadvertent shifting. A spring ring clasp which is stable and esthetic in such a manner can be used directly as an item of jewelry, for example as an armband and above all as a hoop earring. Use of this type can be particularly advantageous because a hoop earring would not have to be bent or stressed as usual when being fitted or removed, for example.

The spring ring clasp has important applications in the jewelry industry. However, said spring ring clasp may also be of interest for other applications. For example, the spring ring clasp can be used as a closure or connection device in handbags, in particular leather handbags. In this way, the spring ring clasp can preferably be used for connecting handles and/or shoulder straps to one another and/or on the body of the bag.

In order for the object mentioned to be achieved, the features of the coordinate claim directed toward the production of a spring ring clasp are provided according to the invention. In particular in order to achieve the object mentioned in the production of the type described at the outset, it is proposed according to the invention that, for producing a spring ring clasp as described above and/or hereunder and/or as claimed, the spring is introduced into the axially bent internal tube, the external tube thereafter is pushed over the internal tube so far that a void in the circumferential direction of the ring is created between free ends of the external tube and of the internal tube, and that the internal tube thereafter is straightened. In this way, a spring ring clasp according to the invention can be produced in a cost-effective and rapid manner.

The production of a spring ring clasp here could be carried out as is explained in more detail hereunder, for example. The external tube and the internal tube can be produced from a precious metal, in particular gold and/or silver, and/or from a non-precious metal, in particular from stainless steel, or from other materials which are preferably used in the jewelry industry. The external tube, which may be able to be produced by spiral welding, could be straightened after being separated from a spiral so that the external tube, should the latter be placed flat, would bear in a planar manner on an even surface throughout. In contrast, the internal tube would not be straightened after being separated from the spiral, as a result of which the winding pitch of the spiral is maintained. Subsequently, the spring would be introduced into the internal tube up to the spring detent. After this process step, the spring protrudes from the internal tube, specifically by a length which can be larger than the travel of the external tube, this here meaning the travel between the end of the tube to the spring detent. The external tube thereafter would be inverted over the spring and subsequently pushed back onto the internal tube, the spring being tensioned in the process. The entire spring ring clasp would now be straightened, wherein the internal tube by means of the pushed-back external tube under the influence of force would be straightened to the extent that both tubes would be in mutual alignment across the imaginary center of said tubes. In a next step, the effect of force of the spring would be set free by releasing the external tube, the spring ring clasp closing as a result. The exact alignment of the internal tube and the external tube would be important here, as a result of which it can be prevented that the external tube runs past a free end of the internal tube. In this production method the fact that the spring would not have to be compressed until the external tube is inverted onto the internal tube would also be advantageous, as a result of which the spring would be protected against damage during production and as a result of which the production is furthermore significantly simplified.

BRIEF DESCRIPTION OF THE DRAWINGS

The invention will now be explained in more detail by means of an exemplary embodiment, but is not limited to the exemplary embodiment. Further exemplary embodiments are derived by combining the features of individual or a plurality of claims with one another and/or with individual or a plurality of features of the exemplary embodiment.

In the figures.

DETAILED DESCRIPTION

Figure 1A:
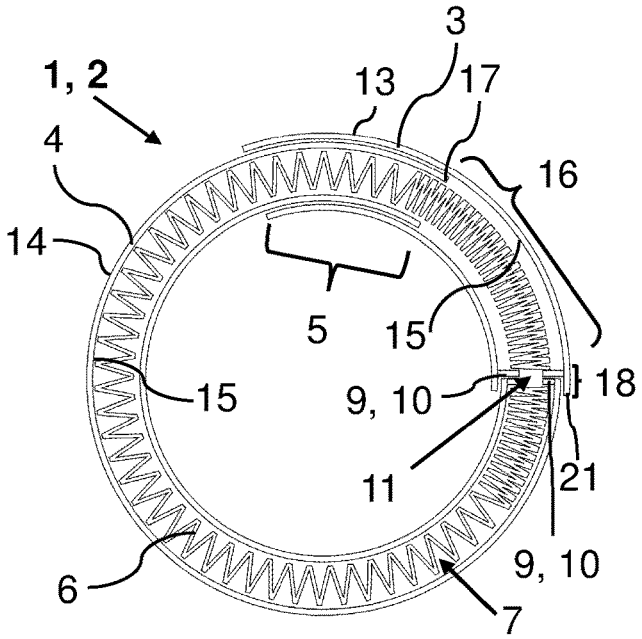
FIGS. 1A and 1B show a cross section of an exemplary embodiment of a spring ring clasp configured according to the invention, in the closed state (FIG. 1A) and the opened state (FIG. 1B)
Figure 1B:
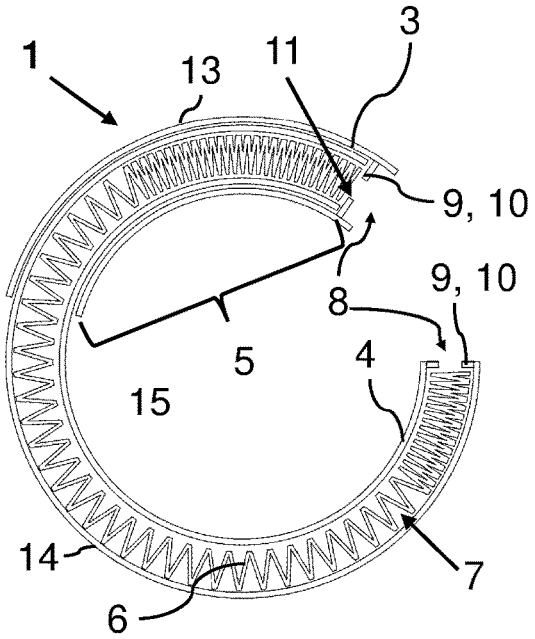
Figure 2A:
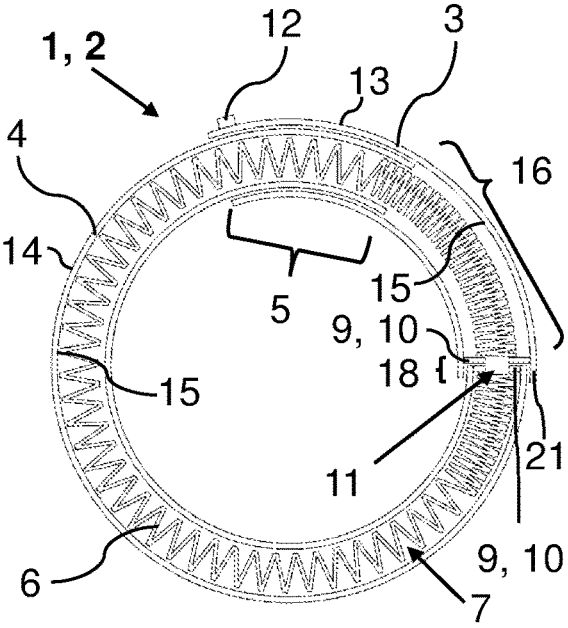
FIGS. 2A and 2B show a cross section of a further exemplary embodiment of a spring ring clasp configured according to the invention, having an attached gripping element in the closed state (FIG. 2A) and the opened state (FIG. 2B)
Figure 2B:
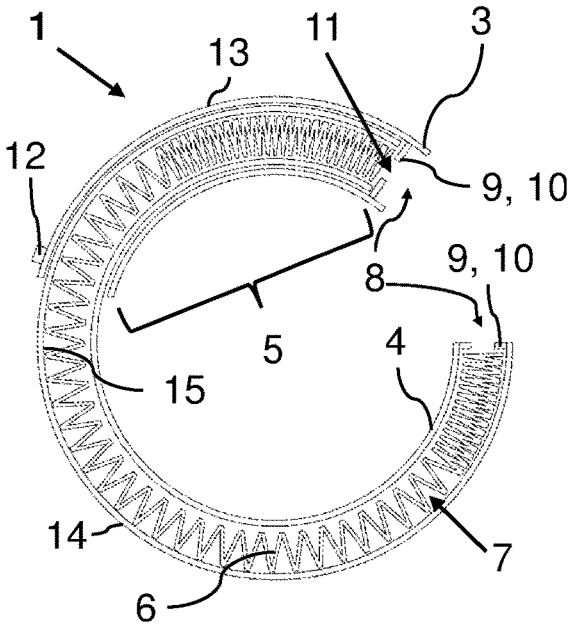

FIGS. 1A and 1B show a cross section of a first exemplary embodiment of a spring ring clasp 1 configured according to the invention. FIGS. 2A and 2B show a cross section of a second exemplary embodiment of a spring ring clasp 1 configured according to the invention. The second exemplary embodiment, with the exception of the presence of an attached gripping element 12, is configured like the first exemplary embodiment such that both exemplary embodiments are conjointly described hereunder.

The spring ring clasp 1 is composed of an external tube 3, an internal tube 4 and a spring 6. The external tube 3 and the internal tube 4 here have a circular cross section. In an alternative exemplary embodiment the cross section may also be, for example, oval, rectangular, triangular or square.

The two tubes 3, 4 can be produced from, for example, gold, silver or stainless steel, this being able to be used in particular in the production of jewelry. In general, a spring ring clasp 1 can be made from at least one precious metal and/or at least one non-precious metal.

The spring ring clasp 1 in the closed state (FIG. 1A and FIG. 2A) forms a closed ring 2 which may have a diameter of less than 10 mm, preferably of less than 6 mm. As has already been described above, the spring ring clasp 1 for reasons of application may also have a diameter of more than 10 mm. The spring ring clasp 1 can ultimately have interesting applications for all size ranges.

The external tube 3 is inverted over the internal tube 4 with minimal play such that the two tubes 3, 4 can be moved relative to one each other and in a guided manner. In the closed state (FIG. 1A and FIG. 2A) an overlap region 5 is formed by the external tube 3 and internal tube 4, which in the opened state (FIG. 1*b* and FIG. 2B) is configured so as to be larger than in the closed state. Furthermore formed is a second overlap region 18, wherein the second overlap region 18 is delimited by the spring detents 10 of the external tube 3 and of the internal tube 4, on the one hand, and by an outer end 21 of the external tube 3, on the other hand. The second overlap region 18 significantly increases the stability and security of the spring ring clasp 1 in the closed state. The free end 8 of the internal tube 4 here engages in the free end 8 of the external tube 3.

When opening the spring ring clasp 1, the external tube 3 is pushed over the internal tube 4 counter to the spring force, as a result of which the overlap region 5 is enlarged. The already pretensioned spring 6 is further tensioned by the opening action. The spring ring clasps 1 illustrated in FIGS. 1A, 1B, 2A, and 2B are configured in such a manner that the spring 6 in the opened and in the closed state is completely covered by the tube assembly formed by the internal tube 4 and the external tube 3. This is enabled by the spring detents 10 which constrict the free ends 8 of the external tube 3 and of the internal tube 4 to the extent that the spring 6, even in the opened state, cannot jump out of the spring ring clasp 1. Rather, the spring 6 pushes against the spring detents 10 and is tensioned as a result.

The spring detents 10 illustrated in FIGS. 1A, 1B, 2A, and 2B as a ring or a plate are soldered to the tubes 3, 4, could alternatively however also be moldings of the external tube 3 or of the internal tube 4, respectively. The spring detents 10 here are identical to detents 9 which in the closed state of the spring ring clasp 1 moreover contact each other (FIG. 1A and FIG. 2A).

Alternatively, the detents 9 and spring detents 10 can also be configured so as not to be identical components. A cavity 7 between the detent 9 and the spring detent 10 of the internal tube 4 and/or between the detent 9 and the spring detent 10 of the external tube 3 can be formed here. The detents 9 in the closed state of the spring ring clasp 1 contact each other here, but the detents 9 no longer contact the spring 6. The spring 6 in this instance contacts the spring detents 10. Since a second cavity 7 can be configured in this way, a first cavity 7, thus the cavity 7 which contains the spring 6, can be of a smaller design.

The spring detents 10 of both tubes 3, 4 each form an opening 11 so that the external tube 3 as well as the internal tube 4 are not completely closed. For example, the openings 11 can serve the purpose of moving the spring 6 by way of a tool, for example in order for the spring 6 to be aligned. Alternatively, only one or neither of the two tubes 3, 4 can have an opening 11 formed by a detent 9 or a spring detent 10.

As can be seen from FIG. 1A and FIG. 2A, the spring 6 in the closed state almost completely encompasses the ring 2. Only a very short portion which is occupied by the two mutually contacting detents 9, 10 is free from the spring 6. The spring travel is therefore maximal.

FIGS. 2A and 2B show a gripping element 12 which can be used for more easily operating the spring ring clasp 1, in particular in the case of small spring ring clasps 1. While the gripping element 12 in FIGS. 2A and 2B is attached to the outside 13 of the external tube 3, a gripping element 12 can also be attached to the outside 14 of the internal tube 4. It is also conceivable for more than one gripping element 12 to be used on one spring ring clasp 1.

The portion 16 of the spring 6 that in the closed state protrudes from the internal tube 4 is more densely wound than a portion of the spring 6 that in the closed state is situated in the internal tube 4 (FIG. 1A and FIG. 2B). As is set forth in FIGS. 1A, 1B, 2A, and 2B, the end of the spring 6 that impacts the free end 8 of the internal tube 4 can also be more intensely wound than the major part of the spring 6 that is situated in the internal tube 4.

The protruding portion 16 of the spring 6 is more densely wound so that the risk of the spring 6 catching on the edges 17 of the internal tube 4 when the spring ring clasp 1 is opened is reduced (FIG. 1A). The spring 6 can be protected in this way, and the spring ring clasp 1 can be more easily opened and closed.

In an alternative exemplary embodiment, the spring 6 across the entire length thereof can also have a consistent winding density. As a result, costs in the production of the spring can be saved, as a result of which the spring ring clasp 1 can be designed in a more cost-effective and thus more customer-friendly manner.

The external tube 3 and the internal tube 4 on the shell face thereof are completely closed. The stiffness of the external tube 3 and of the internal tube 4 is increased as a result, such that twisting and, as a result inadvertent opening, of the spring ring clasp 1 can be prevented.

The mechanism of the spring ring clasp 1 described above, or claimed hereunder, respectively, can be used in closures, pendants, bracelets and hoop earrings 19, for example.

Figure 3A:
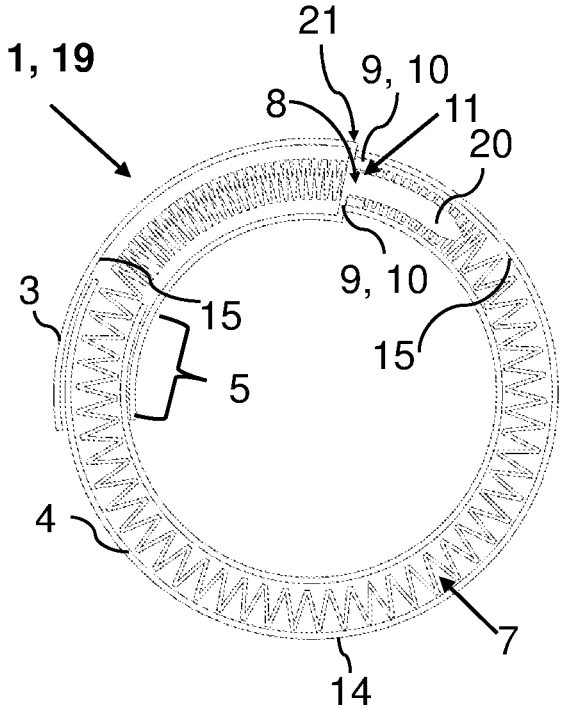
FIGS. 3A-3C show a cross section of a third exemplary embodiment, wherein the spring ring clasp is illustrated as a hoop earring in the closed state (FIG. 3A) and the opened state (FIG. 3B) and in a worn state (FIG. 3C).
Figure 3B:
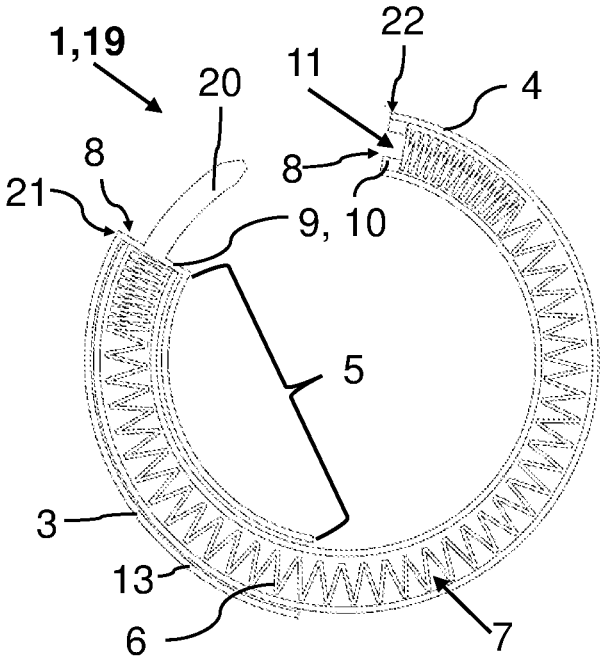
Figure 3C:
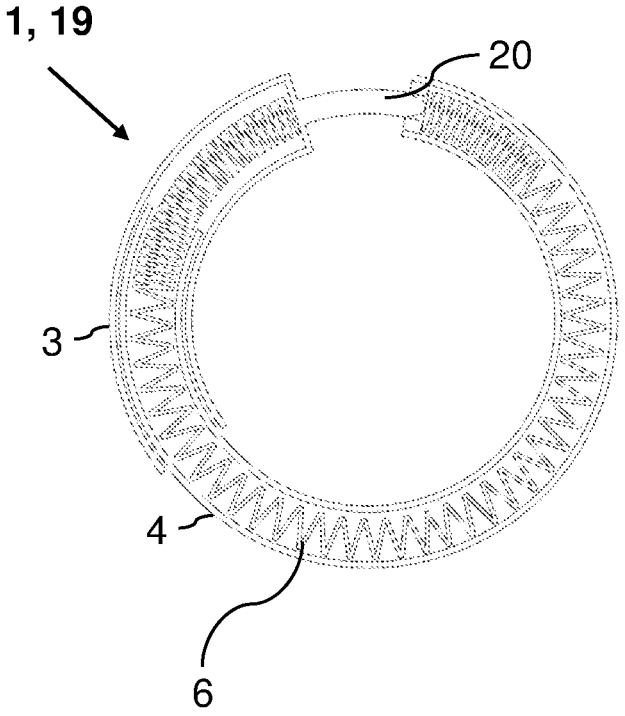

FIGS. 3A-3C show a spring ring clasp 1 configured as a hoop earring 19. Components and functional units which in terms of function and/or construction are equivalent or identical to those of the preceding exemplary embodiments are identified by the same reference signs and are not separately described once again. The explanations pertaining to FIGS. 1A, 1B, 2A, and 2B therefore apply in analogous manner to FIGS. 3A-3C.

In the hoop earring 19 shown in FIGS. 3A-3C, the spring detent 10 of the external tube 3 is not offset toward the rear but disposed so as to be flush on the outer end 21 of the external tube 3. A pin 20 is configured on the spring detent 10, in particular soldered to the latter. In the closed state, the pin 20 protrudes into the free end 8 of the internal tube 4, wherein the pin 20 engages through the opening 11 of the spring detent 10 of the internal tube 4 and through the internal diameter of the spring 6 (FIG. 3A). It can be provided in an exemplary embodiment not shown that a pin 20 protrudes through an opening 11 of a detent 9 of an internal tube 4 and engages through a second cavity 7 up to a spring detent 10 of the internal tube 4.

In the spring ring clasp 1 configured as a hoop earring 19 it is advantageous that ear holes can be obscured by the external tube 3 or the internal tube 4, respectively. In general, a hoop earring 19 can advantageously be adaptable to any ear thickness.

In order for a hoop earring 19 to be fitted, the latter is opened (FIG. 3B) and the pin 20 is inserted through an ear hole. The pin 20 thereafter is aligned with the free end 8 of the internal tube 4 such that the hoop earring 19, upon releasing the external tube 3 or the internal tube 4, respectively, is closed by virtue of the spring force without the pin 20 running past the outer end 22 of the internal tube 4. The spring 6 here is made such that the hoop earring 19 is able to be closed without pressure pains arising on the ear. The spring ring clasp 1 in this instance can assume the state according to FIG. 3C, for example.

In an embodiment of a hoop earring 19 not shown, an end cap which has a larger diameter than the external tube 3 can be attached to the outer end 21 of the external tube 3. Alternatively or additionally, an end cap which has a larger diameter than the internal tube 4 can be configured on the outer end 22 of the internal tube 4. As a result, an even higher level of wear comfort can be achieved, because the force is distributed across a larger area and a lower pressure consequently arises on the earlobe.

The invention generally proposes a spring ring clasp with a closed state in which the spring ring clasp 1 forms a closed ring 2, and with an opened state in which the ring 2 is opened, having an external tube 3, an internal tube 4 which in an overlap region 5 protrudes into the external tube 3, and a spring 6 which is disposed in a cavity 7 configured by the external tube 3 and the internal tube 4, the external tube 3 for opening the spring ring clasp 1 being displaceable relative to the internal tube 4 counter to a spring force caused by the spring 6 with the overlap region 5 being enlarged, and the spring 6 at least in the closed state protruding from the internal tube 4 and protruding into the external tube 3. The use of such a spring ring clasp 1 is preferably of interest in the jewelry industry but is not limited to this sector.

LIST OF REFERENCE SIGNS

1 Spring ring clasp
2 Ring
3 External tube
4 Internal tube
5 Overlap region
6 Spring
7 Cavity
8 Free end
9 Detent
10 Spring detent
11 Opening
12 Gripping element
13 Outside of the external tube 3
14 Outside of the internal tube 4
15 Shell face
16 Portion of the spring 6
17 Edges
18 Second overlap region
19 Hoop earring
20 Pin
21 Outer end of 3
22 Outer end of 4

The invention claimed is:

1. A spring ring clasp (1) with a closed state in which the spring ring clasp (1) forms a ring (2) that is closed, and with an opened state in which the ring (2) is opened, the spring ring clasp (1) comprising:

an external tube (3);

an internal tube (4) which in an overlap region (5) protrudes into the external tube (3); and a spring (6) which is disposed in a cavity (7) configured by the external tube (3) and the internal tube (4), the external tube (3) for opening the spring ring clasp (1) being displaceable relative to the internal tube (4) counter to a spring force caused by the spring (6), and the spring (6) at least in the closed state protruding from the internal tube (4) and protruding into the external tube (3).

2. The spring ring clasp (1) as claimed in claim 1, wherein the internal tube (4) and the external tube (3) in the opened state each include free ends (8) which contact each other in the closed state, the free end (8) of the internal tube (4) in the closed state engaging in the free end (8) of the external tube (3).

3. The spring ring clasp (1) as claimed in claim 2, wherein configured on the free end (8) of the external tube (3) is a pin (20) which in the closed state protrudes into the internal tube (4), or configured on the free end (8) of the internal tube (4) is a pin (20) which in the closed state protrudes into the external tube (3).

4. The spring ring clasp (1) as claimed in claim 1, wherein a detent (9) is located at least one of on or in the external tube (3) or on or in the internal tube (4).

5. The spring ring clasp (1) as claimed in claim 1, further comprising a spring detent (10) which in the opened state and in the closed state is contacted by the spring (6) is located on or in at least one of the external tube (3) or the internal tube (4).

6. The spring ring clasp (1) as claimed in claim 1, wherein at least one of the external tube (3) or the internal tube (4) on a free end (8) thereof is opened.

7. The spring ring clasp (1) as claimed in claim 6, wherein a detent (9) configured in or on the external tube (3) includes an opening (11) such that said detent (9) does not completely close the external tube (3).

8. The spring ring clasp (1) as claimed in claim 6, wherein a detent (9) configured in or on the internal tube (4) includes an opening (11) such that said detent (9) does not completely close the internal tube (4).

9. The spring ring clasp (1) as claimed in claim 1, wherein exclusively the spring (6) is disposed in the cavity (7).

10. The spring ring clasp (1) as claimed in claim 1, wherein the spring (6) in the opened state and in the closed state is completely covered by a tubular assembly formed by the internal tube (4) and the external tube (3).

11. The spring ring clasp (1) as claimed in claim 1, wherein the external tube (3) and the internal tube (4) are free from gripping elements (12).

12. The spring ring clasp (1) as claimed in claim 1, wherein at least one of the external tube (3) or the internal tube (4) on a shell face (15) thereof is completely closed.

13. The spring ring clasp (1) as claimed in claim 1, wherein a portion (16) of the spring (6) that in the closed state protrudes from the internal tube (4) is more densely wound than a portion of the spring (6) that in the closed state is situated in the internal tube (4).

14. The spring ring clasp (1) as claimed in claim 1, wherein the spring ring clasp (1) is configured for hooking thereinto an item of jewelry.

15. The spring ring clasp (1) as claimed in claim 1, wherein a respective detent (9) is located at least on or in the external tube (3) and on or in the internal tube (4), and the detents (9) contact each other in the closed state.

16. The spring ring clasp (1) as claimed in claim 1, wherein the spring ring clasp (1) consists of the external tube (3), the internal tube (4) and the spring (6).

17. The spring ring clasp (1) as claimed in claim 1, wherein the spring ring clasp (1) has a diameter of less than 10 mm.

18. A method of producing a spring ring clasp (1) which has a closed state in which the spring ring clasp (1) forms a ring (2) that is closed, and with an opened state in which the ring (2) is opened, the method comprising:

introducing a spring (6) into an axially bent internal tube (4), and thereafter pushing an external tube (3) over the internal tube (4) so far that a void in a circumferential direction of the ring (2) is created between free ends (8) of the external tube (3) and of the internal tube (4).

* * * * *